US006622384B1

(12) United States Patent
Spinks et al.

(10) Patent No.: US 6,622,384 B1
(45) Date of Patent: Sep. 23, 2003

(54) METHOD AND APPARATUS FOR FORMING SPRING UNITS

(75) Inventors: Peter Douglas Spinks, Sherburn-in-Elmet (GB); Simon Paul Spinks, Sherburn-in-Elmet (GB)

(73) Assignee: A Harrison (Bedding) Limited, Leeds (GB)

( * ) Notice: Subject to any disclaimer, the term of this patent is extended or adjusted under 35 U.S.C. 154(b) by 0 days.

(21) Appl. No.: 09/588,403

(22) Filed: Jun. 6, 2000

(51) Int. Cl.[7] ..... B21F 35/00

(52) U.S. Cl. ..... 29/896.92; 29/91; 53/114; 53/438

(58) Field of Search ..... 29/896.92, 91; 53/114, 438; 140/3 CA; 267/85, 86

(56) References Cited

U.S. PATENT DOCUMENTS 1,192,510 A * 7/1916 Fischmann ..... 5/253
1,566,068 A * 12/1925 Brundage ..... 53/114
2,093,531 A * 9/1937 Werner ..... 53/114
4,439,977 A * 4/1984 Stumpf ..... 53/114
5,471,725 A * 12/1995 Thrasher ..... 29/896.92
6,021,627 A * 2/2000 Mossbeck et al. ..... 53/114

FOREIGN PATENT DOCUMENTS

GB 235481 6/1925
WO 98/25503 6/1998

* cited by examiner

*Primary Examiner*—P. W. Echols
(74) *Attorney, Agent, or Firm*—Klauber & Jackson

(57) ABSTRACT

A method and apparatus for forming spring units for use in a mattress, bed, divan bed, or other upholstered unit, the method including the step of inserting a second spring (12A) into a first spring immediately prior to said first spring being formed into a pocketted spring. The second spring (12A) may be formed into a pocketted spring prior to insertion into said first spring.

Figure 1:
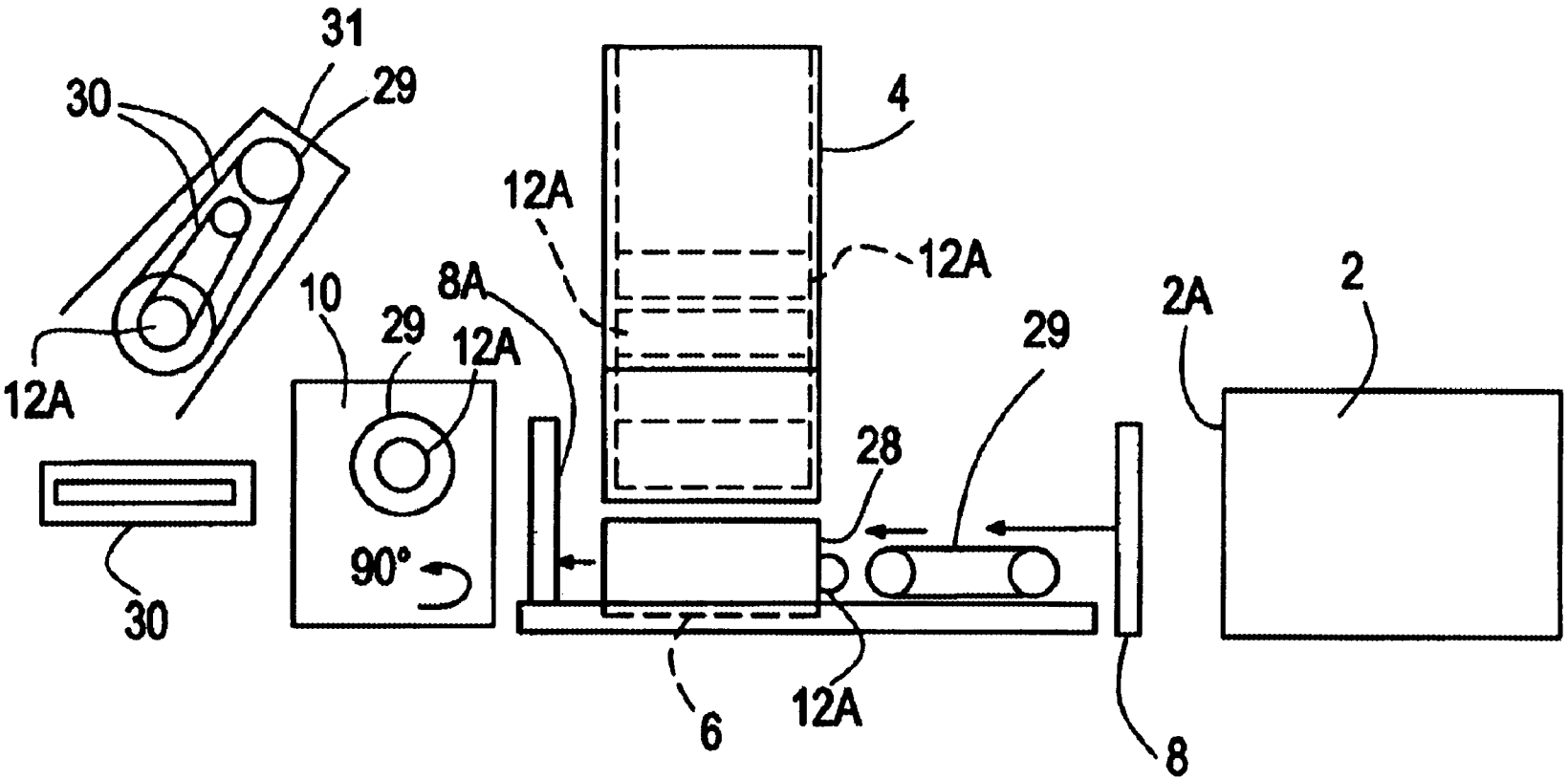

The apparatus includes means (4) for feeding a second spring (12A) to a composite spring forming station (6) immediately prior to a first spring being fed to said station, means to compress and rotate the formed composite spring (30) through substantially 90°, means to insert the composite spring into a sleeve of material, and means to form said composite spring and a portion of said sleeve into a pocketted spring unit.

8 Claims, 2 Drawing Sheets

METHOD AND APPARATUS FOR FORMING SPRING UNITS

This application claims priority under 35 USC 120 to PCT/GB98/03741, which claims priority to GB 9726333.9.

This invention relates to spring units and in particular to a method and apparatus for producing such spring units.

In our co-pending International Patent Application No PCT/GB 97/01759 there are disclosed spring units comprising inner and outer springs for use in mattresses, beds, divan beds, and other upholstered units. The spring units disclosed in said co-pending patent application are pocketted spring units in which either the outer spring or the inner spring, or both the outer spring and the inner spring, is (are) enclosed in a covering or pocket of material so as to form the spring unit, and the present invention relates to a method and apparatus for making the spring units disclosed in said co-pending patent application. Spring units comprising an inner spring and an outer spring are known—see for example United Kingdom Patent No 235,481. In said United Kingdom Patent No 235,481 there is disclosed a spring unit comprising an inner pocketted spring and an outer spring surrounding said pocketted spring, but because of the format of the spring unit, the method and apparatus for the production of the spring unit are not thought suitable for the production of the spring units disclosed in our said co-pending patent application.

According to one aspect of the present invention there is provided a method for the production of a spring unit for use in a mattress, bed, divan bed, or other upholstered unit, the method including the steps of positioning a second spring in readiness for insertion into a first spring, feeding said first spring from a supply source immediately after said second spring is positioned in readiness for insertion into said first spring, positioning said second spring within said first spring, and forming said first spring into a pocketted spring.

The method may include the steps of feeding said first spring from a spring supply source immediately after said second spring is positioned in readiness for insertion into said first spring.

The method may include the still further step of compressing said first and second springs together, turning said compressed springs through 90°, feeding said compressed springs into a sleeve of material and forming said compressed springs and a portion of said sleeve of material into a pocketted spring unit.

The method may include the further step of forming said second spring into a pocketted spring prior to said second spring being fed into position for insertion into said first spring.

According to a second aspect of the present invention there is provided a method for the production of a spring unit for use in a mattress, bed, divan bed, or other upholstered unit, the method comprising the steps of forming a first spring in a spring forming machine, feeding a second spring to a composite spring forming station, feeding said first spring to said spring forming station, inserting said second spring within said first spring so as to form a composite spring, compressing said composite spring and turning said composite spring through substantially 90°, inserting said turned compressed composite spring into a sleeve of material, and forming said compressed composite spring and a portion of said sleeve into a pocketted spring unit.

Preferably, the method will include the additional step of forming said second spring into a pocketted spring prior to it being fed to said composite spring forming station.

According to a third aspect of the present invention there is provided apparatus for forming a spring unit for use in a mattress, bed, divan bed, or other upholstered unit, said apparatus comprising means for feeding a second spring to a composite spring forming station immediately prior to a first spring being fed to said composite spring forming station, means to move said first spring to said composite spring forming station and around said second spring such that the second spring lies within said first spring so as to form a composite spring, and means to form said composite spring into a pocketted spring.

Said means will preferably be a chute or store housing a plurality of second springs, one of said second springs falling from said chute or store and being fed by feeder means into or onto said spring forming station immediately prior to said first spring being fed to said station.

The apparatus will preferably include means to turn the composite spring formed at said spring forming station through 90°, means to feed said composite spring into a sleeve of material, and means to form said composite spring and a portion of said sleeve into a pocketted spring unit.

Figure 2:
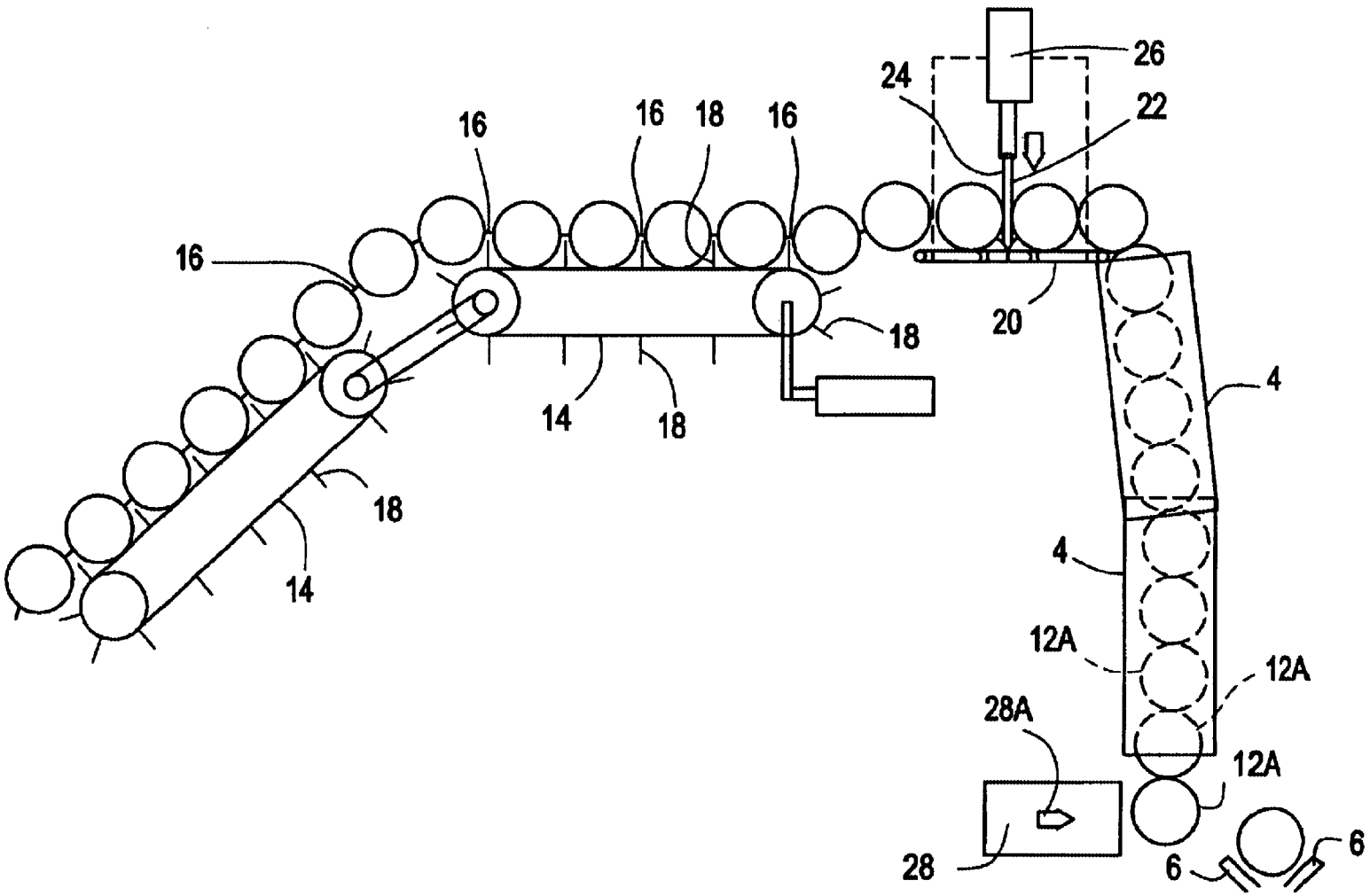

In order that the invention may be more readily understood, an embodiment thereof will now be described, by way of example only, reference being made to the accompanying drawings, wherein:

FIG. 1 is a block diagram showing the principal component parts of spring unit forming apparatus in accordance with the invention; and FIG. 2 is an elevation of part of the spring forming apparatus shown in FIG. 1.

Referring to the drawings and firstly to FIG. 1, apparatus for forming a spring unit for use in mattresses, beds, divan beds, and other upholstered units, comprises a spring forming unit 2 for forming first springs, a supply source 4 for second springs, a pair of spaced fixed guides 6, a movable plate or paddle 8, and a composite spring turning unit 10.

The spring forming unit 2—which is known and which therefore will not be described in detail herein as it forms no part of the present invention—forms a spring (not shown)—a first spring—from wire fed to said unit. The formed spring exits at point 2A, and is fed onto the guides 6 by the movable plate or paddle 8, the latter being pivotable out of the way to enable the spring to leave the unit 2 and being movable from its full line position shown at 8 to the phantom position shown at 8A.

The supply source 4 contains a plurality of second springs, several of which are indicated by reference numerals 12A, the second springs preferably being pocketted springs.

Referring to FIG. 2, the second springs 12A are fed to the supply source 4, which is in the form of a chute, on conveyors 14 from pocketted spring forming machinery or apparatus (not shown). When on the conveyors, the pocketted springs 12A are in continuous form in that adjacent pocketted springs are joined together by webs 16. In order to have the pocketted springs 12A in a desired spaced relationship —whilst they are still connected and on the conveyors 14—the conveyors carry outwardly extending spacer members 18. From the conveyors 14, the connected pocketted springs are transferred onto a spring-loaded conveyor belt 20, the connected springs then being separated by a vertically reciprocable blade 22 which is held in a guide 24 connected to a fluid-operated piston-and-cylinder arrangement 26. Once separated from its adjacent pocketted spring, the individual pocketted spring is transferred by the conveyor belt 20 to the chute 4. After formation into individual pocketted springs (second springs), the excess material of the pocket, at least at one end of the pocket, is moved inwardly to lie within the pocket—and possibly but not necessarily secured in that position by means (not shown)—such that it will not foul the first spring when the latter is being fed over the pocketted spring at the composite spring forming station.

At the exit point of the chute 4 is a transfer or pusher mechanism 28 which is movable in the direction of arrow 28A to transfer a pocketted spring 12A (a second spring) exiting from the chute 4 to the spaced guides 6 forming the composite spring forming station.

In the use of the apparatus, and referring to FIG. 1, when a first spring 29 exits from the spring forming unit 2 at position 2A, the plate or paddle 8 has pivoted to enable such exit to take place and is returning from position 8A to position 8. As soon as the plate or paddle 8 pivots at position 8A, and during its return to position 8, a pocketted spring (a second spring) 12A is released from the chute 4 and fed onto the spaced guides 6 by the transfer of pusher mechanism 28.

Thereafter, the plate or paddle 8 pivots back to its in-line position and engages the rear of the first spring 29 which has exited from the machine 2, the plate or paddle 8 then moving in the direction of the arrows to move the first spring 29 onto the spaced guides 6 (composite spring forming station) and around the pocketted spring 12A (second spring) already on the spaced guides such that the second spring lies within the first spring, thus forming a composite spring 30.

Continued movement of the plate or paddle 8 moves the composite spring 30, which comprises the pocketted spring (second spring) 12A and the first spring 29 and compresses the composite spring, whereafter the compressed composite spring is fed into the unit 10 where it is turned substantially 90°. The composite spring, which is shown inside the unit 10 after being turned substantially 90°, upon leaving the unit 10, enters a sleeve 31 of material, the sleeve and composite spring 30 then moving to a pocketted spring forming machine (not shown) in which the composite spring 30 is sealed within the material sleeve so as to form a spring unit consisting of a double pocketted spring, i.e. an inner pocketed spring and outer pocketted spring, which together form a spring unit for use as detailed above.

It will be appreciated that instead of the pocketted springs 12A being fed into the chute 4 direct from the forming machine via the conveyors 14 and being separated whilst on the conveyors, they may be formed and separated remote from the chute and thereafter loaded into the chute 4 in readiness for feeding to the composite spring forming station.

Although not previously referred to, the pocketted springs 12A and the double pocketted springs—the spring units—are formed by stitching or sewing at appropriate positions on the sleeve of material to enclose the springs with a portion of the material. Instead of the use of sewing or stitching however, heat welding or sonic welding techniques may be used to form the pockets.

Thus, in the embodiment of the invention described, there is provided a method of and apparatus for the production of a double pocketted spring—a spring unit—which is continuous from the feeding of the wire to the machine for forming the first spring to the formation of the finished spring unit.

Finally, it will be appreciated that the second spring need not itself be a pocketted spring—it may be inserted into the first spring without having a covering of material thereon.

What is claimed is:

1. A method for the production of a spring unit for use in a mattress, bed, divan bed, wherein the method comprises the steps of positioning of a second spring (12A) in a readiness position to enable a first spring to be moved around the second spring so that the second spring is arranged within an interior of the first spring, feeding said first spring from a supply source immediately after said second spring (12A) is positioned in the readiness position, moving the first spring around the second spring so that the second spring is positioned within the interior of the first spring, and forming said first spring into a pocketted spring.

2. A method according to claim 1, characterised in that the method includes the further steps of compressing said first spring and said second spring (12A), turning said compressed springs through substantially 90°, feeding said compressed and turned spring into a sleeve of material and forming said compressed springs and a portion of said sleeve into a pocketted spring unit.

3. A method according to claim 1 or claim 2, further including the step of forming said second spring (12A) into a pocketted spring prior to said second spring (12A) being fed into the readiness position so that said first spring can be moved around the second spring so that the second spring is positioned within the interior of the first spring.

4. An apparatus for a spring unit for use in a mattress, bed, divan bed, said apparatus comprises means (28) for feeding a second spring (12A) to a composite spring forming station (6) immediately prior to a first spring being fed to said composite spring forming station (6), means (8) to move said first spring to said composite spring forming station (6) and around said second spring (12A) such that the second spring (12A) lies within said first spring so as to form a composite spring (30), and means to form said composite spring (30) into a pocketted spring unit.

5. Apparatus according to claim 4, characterised in that said apparatus includes means (8) to compress said composite spring (30), means (10) to turn said compressed composite spring (30) through substantially 90°, means to feed said compressed and turned composite spring (30) into a sleeve of material, and means to form said composite spring (30) and a portion of said sleeve of material into a pocketted spring unit.

6. Apparatus according to claim 5, characterised in that the apparatus includes means to sever the sleeve of material so that the spring units are formed into discrete spring units.

7. Apparatus according to claim 6, characterised in that said means to move said first spring to said composite spring forming station (6) comprises a paddle or plate (8) which is pivotable from an operative position to an inoperative position and which is movable from a first position to feed a first spring to said composite spring forming station (6).

8. Apparatus according to claim 6, characterised in that means are provided to form said second springs (12A) into pocketted springs prior to being fed to said composite spring forming station (6).

* * * * *

UNITED STATES PATENT AND TRADEMARK OFFICE

CERTIFICATE OF CORRECTION

PATENT NO. : 6,622,384 B1 
DATED : September 23, 2003
INVENTOR(S) : Peter Douglas Spinks and Simon Paul Spinks It is certified that error appears in the above-identified patent and that said Letters Patent is hereby corrected as shown below:

Title page,
Item [30], Foreign Application Priority Data, insert:
-- United Kingdom 9726333.9, filed 12/13/1997 --
Item [87], add the following PCT Application Information:
-- PCT No.: PCT/GB98/03741, filed December 14, 1998 --

Signed and Sealed this

Tenth Day of February, 2004

JON W. DUDAS
*Acting Director of the United States Patent and Trademark Office*